US006070648A

United States Patent [19]

Pleschiutschnigg

[11] Patent Number: 6,070,648

[45] **Date of Patent: *Jun. 6, 2000**

[54] METHOD FOR PREVENTING SNAKING OF CONTINUOUSLY CAST METAL SLAB

[75] Inventor: Fritz-Peter Pleschiutschnigg, Duisburg, Germany

[73] Assignee: Mannesmann Aktiengesellschaft, Düsseldorf, Germany

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/682,669

[22] PCT Filed: Jan. 20, 1995

[86] PCT No.: PCT/DE95/00093

§ 371 Date: Jul. 29, 1996

§ 102(e) Date: Jul. 29, 1996

[87] PCT Pub. No.: WO95/20446

PCT Pub. Date: Aug. 3, 1995

[30] Foreign Application Priority Data

Jan. 28, 1994 [DE] Germany ..... 44 03 047

[51] Int. Cl.[7] ..... B22D 11/041; B22D 11/128

[52] U.S. Cl. ..... 164/484; 164/442

[58] Field of Search ..... 164/448, 442, 164/459, 476, 484, 417, 424

[56] References Cited

U.S. PATENT DOCUMENTS

| | | | |
|---|---|---|---|
| 4,018,261 | 4/1977 | Scheinecker et al. | 164/442 X |
| 4,074,746 | 2/1978 | Scheurecker et al. | 164/442 |
| 4,955,428 | 9/1990 | Schrewe | 164/442 X |
| 5,188,167 | 2/1993 | Perry et al. | 164/418 |
| 5,460,220 | 10/1995 | Coassin | 164/442 X |

FOREIGN PATENT DOCUMENTS

| | | | |
|---|---|---|---|
| 62-9758 | 1/1987 | Japan | 164/442 |
| 62-148064 | 7/1987 | Japan | 164/484 |
| 63-286259 | 11/1988 | Japan | 164/442 |
| 2-207953 | 8/1990 | Japan | 164/442 |
| 4-89161 | 3/1992 | Japan | 164/442 |
| 5-245604 | 9/1993 | Japan | 164/476 |
| 5-253645 | 10/1993 | Japan | 164/442 |
| 1771870 | 10/1992 | U.S.S.R. | 164/476 |

*Primary Examiner*—J. Reed Batten, Jr.

*Attorney, Agent, or Firm*—Cohen, Pontani, Lieberman & Pavane

[57] ABSTRACT

Molten metal is poured into a continuous casting mold having a rectangular mold exit opening to produce a rectangular metal strand having a liquid core, a width and a thickness. A convex shape is imparted to the rectangular strand along at least a part of the width thereof downstream of the casting mold by arranging a plurality of oppositely disposed guide rolls immediately downstream of the rectangular mold exit opening so that the cast strand while travelling from the mold exit opening through the plurality of guide rolls expands along at least part of its width no more than 8% of the strand thickness, thereby preventing snaking of the strand.

5 Claims, 4 Drawing Sheets

METHOD FOR PREVENTING SNAKING OF CONTINUOUSLY CAST METAL SLAB

BACKGROUND OF THE INVENTION

The invention is directed to a strand guide stand which prevents a weaving motion of a cast strand.

DESCRIPTION OF THE PRIOR ART

Strand guide stands in which the rolls have curved rather than straight surface lines are known from the prior art, e.g., DE 36 27 991 C2. Such rolls are used whenever the mold outlet cross section produces a strand cross section substantially deviating from the rectangular form.

Generally, for rectangular strands with strand thicknesses greater than 60 to 80 mm, rolls with straight surface lines are used in the strand guide stand directly below the continuous casting mold (segment 0) and the surface lines of rolls located opposite one another in pairs lie parallel to one another.

In strand guide stands having such rolls, the casting speed is limited by a weaving or wobbling motion of the strands so that the following values are conventionally applied:

approximately 1.8–2.0 m/min for slabs with a thickness of 230 mm approximately 1.5–1.7 m/min for blooms with a thickness of 270 mm approximately 2.5 m/min for billets with a size of 100× 100 mm.

SUMMARY AND DESCRIPTION OF THE INVENTION

Figure 1A:
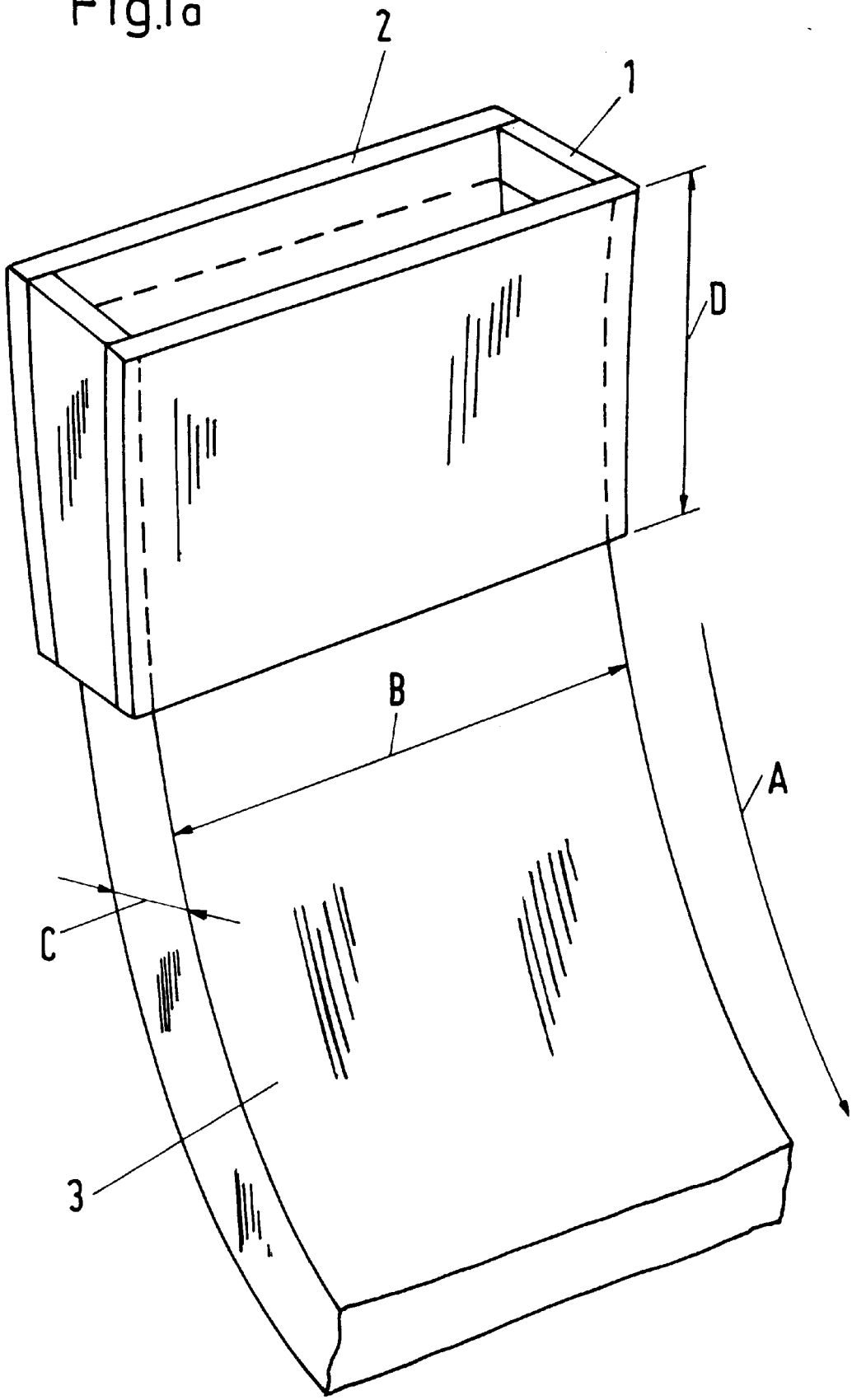
FIG. 1*a* is a schematic view of the rectangular mold and cast strand of the instant invention.
Figure 1B:
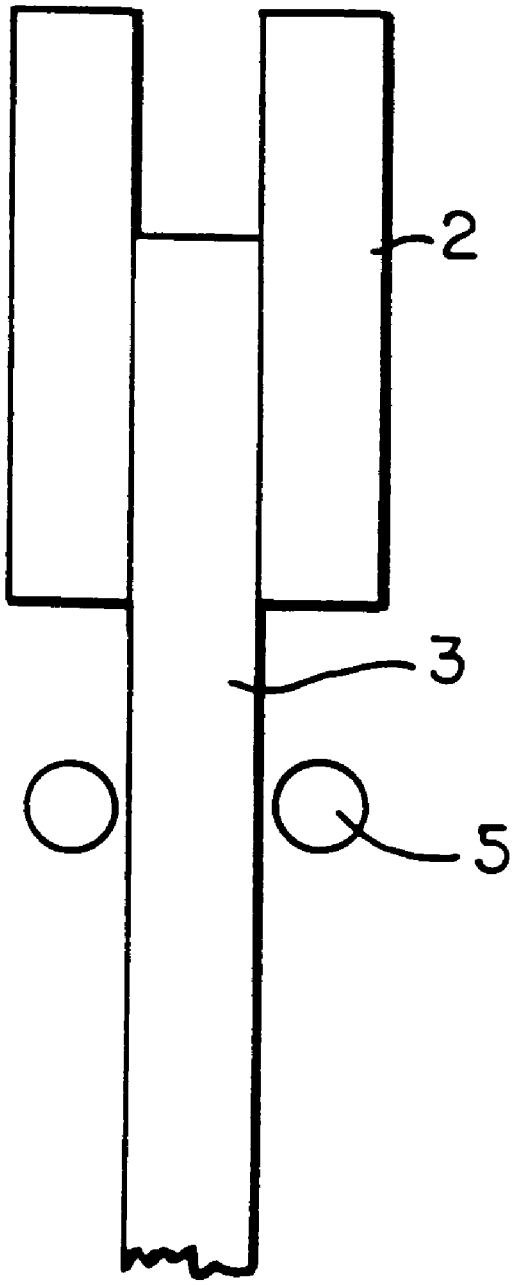
FIG. 1*b* is a schematic side view of FIG. 1*a;*
Figure 2:
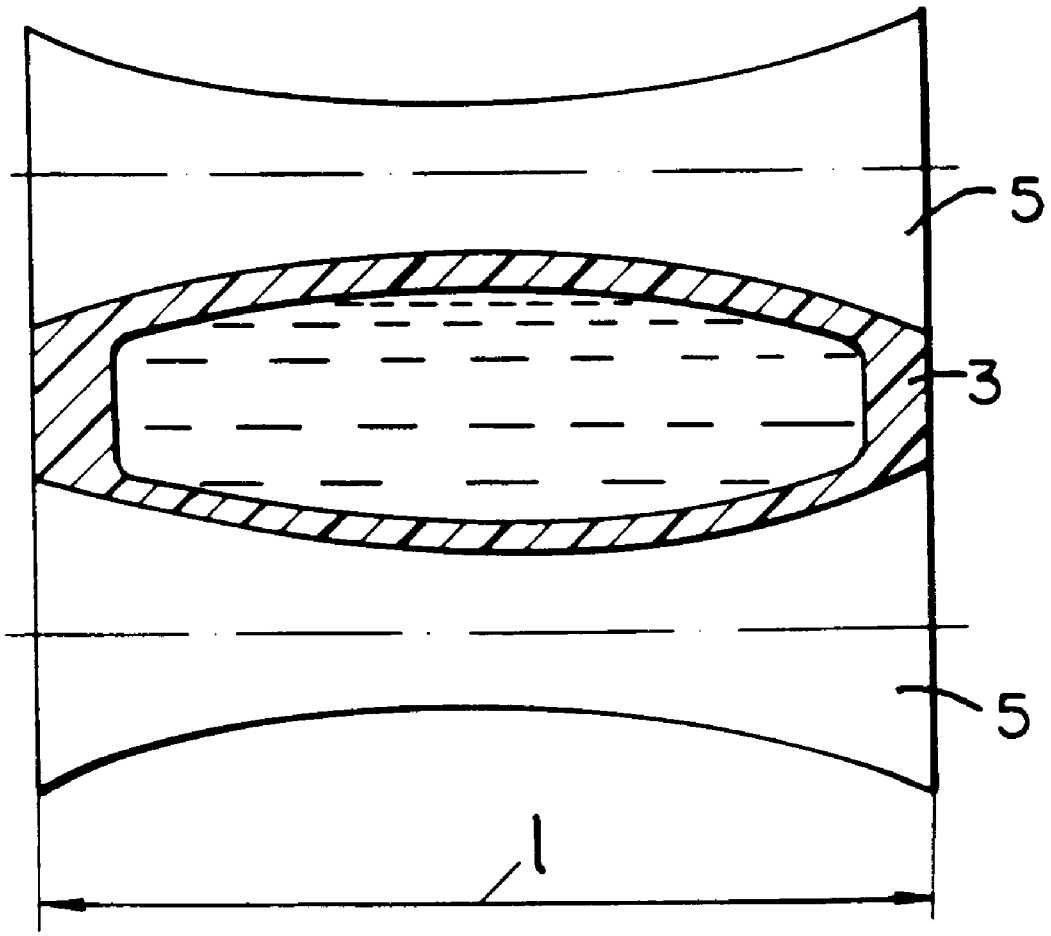
FIG. 2 is a partial cross-sectional view of the cast strand permitted to expand due to the concave surface line of the guide rolls.
Figure 3A:
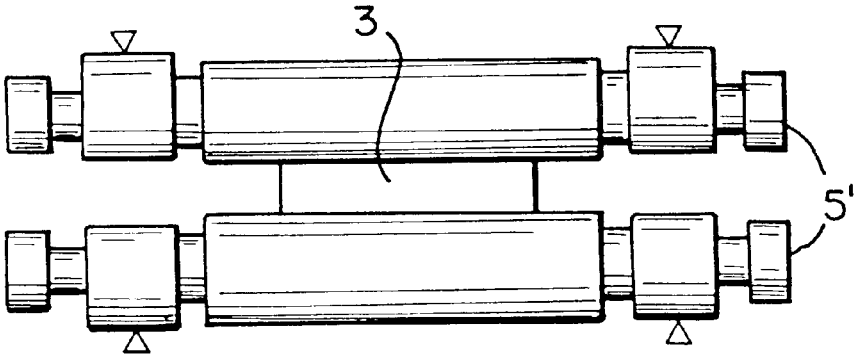
FIG. 3*a* is a schematic view of the guide rolls of the instant invention in parallel and position.
Figure 3B:
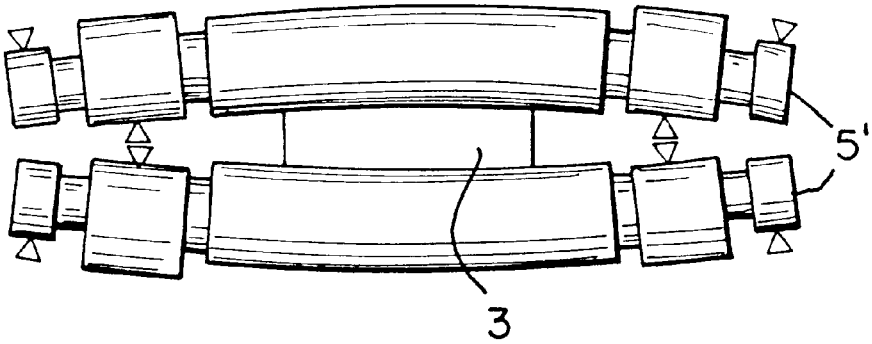
FIG. 3*b* is a view of the guide rolls in concave position.

The object of the present invention is to provide rolls for the strand guide stands for rectangular strands which rolls are designed so that a weaving or wobbling motion of the strands is prevented.

Pursuant to this object, and others which will become apparent hereafter, one aspect of the present invention resides in a strand guide stand for a continuously cast rectangular strand, which guide stand includes guide rolls and driving rolls located opposite one another in pairs. The rolls have a slightly concave surface line, at least when loaded, so that the strand is accurately guided without weaving. This configuration of the rolls permits the strands to expand spherically upon exiting the continuous casting mold.

In another embodiment of the invention the rolls are configured to have a concave surface line with a maximum concavity of no more than 8%, and preferably 2–4%, of the strand thickness.

In still another embodiment of the invention the strand guide stand is configured to bend under casting load in a range of elasticity so as to form the concave surface line of the guide rolls and the driving rolls.

In yet another embodiment of the invention, the rolls are configured so that the concave surface line extends over a part, preferably 40%, of the strand width.

It has been shown that when using continuous casting molds with a rectangular cross section and cylindrical guide rolls, which is presently the case in the majority of continuous casting installations throughout the world, the casting speed may not exceed specified maximum values because, otherwise, the number of breakout defects in the strand increases disproportionately. This is a result of the fact that the strand begins to weave, that is, to move back and forth between the guide rolls, if a determined casting speed is exceeded. This leads to an uneven transfer of heat at the strand in the vicinity of the mold outlet cross section, which results in stress cracks and breakout.

Surprisingly, it has now been found that a slight camber of the strand prevents weaving. In so doing, the strand expands to the extent determined by the concave surface lines of the rolls immediately upon exiting the mold due to the still liquid core and the small thickness of the strand shell. Thus, the strand contacts the rolls and is guided so as to prevent weaving, or "snaking" as it is called in the technical literature.

The camber can extend over a part of the strand width or over the entire width of the strand. The total bulging of the strand should amount to 8%, preferably 2–4%. Increasing this value does not improve guidance, but only results in unnecessary rolling effort. A camber along the entire width of the strand in the range of 2–4% provides a substantially better initial cross section for the subsequent rolls and meets the requirements of rolling mill engineers in this respect. The camber of the strand is expediently provided by means of (for example) concave rolls arranged up to the end of the strand guide stand or by means of a corresponding arrangement of split rolls in the strand guide area or by means of bending of the strand guide stands and/or of the rolls in the elasticity range.

The present invention not only makes possible a corresponding increase in the casting speed in new installations, but also allows the casting speed in existing installations to be increased by up to 200% compared with the values indicated above by retrofitting with suitably cambered rolls pursuant to the present invention while at the same time increasing the reliability of the casting process.

What is claimed is:

1. A method of preventing snaking of a strand of cast metal in a continuous casting device, comprising the steps of:

(a) pouring molten metal into a continuous casting mold having a rectangular mold exit opening to produce a rectangular metal strand having a liquid core, a width and a thickness; and (b) imparting to said rectangular strand a convex shape along at least a part of the width thereof downstream of said casting mold by arranging a plurality of oppositely disposed guide rolls immediately downstream of said rectangular mold exit opening so that the cast strand while travelling from said mold exit opening through said plurality of guide rolls expands along at least a part of its width no more than 8% of said strand thickness, thereby preventing snaking of the strand.

2. The method of claim 1, wherein the step (b) is performed by permitting the cast strand to expand no more than 2–4% of the strand thickness.

3. The method of claim 1, wherein the convex shaped is imparted to the rectangular strand by bending the guide rolls in the range of elasticity under cast load.

4. The method of claim 1, wherein the convexity of the strand extends along the entire width thereof.

5. The method of claim 1, wherein the convexity of the strand extends along 40% of the strand width.

* * * * *